US009546500B2

(12) United States Patent
Choi

(10) Patent No.: US 9,546,500 B2
(45) Date of Patent: Jan. 17, 2017

(54) TENT FRAME

(71) Applicant: Campvalley (Xiamen) Co. Ltd., Xiamen, Fujian Province (CN)

(72) Inventor: Kwan Jun Choi, Xiamen (CN)

(73) Assignee: Campvalley (Xiamen) Co. Ltd., Xiamen (CN)

( * ) Notice: Subject to any disclaimer, the term of this patent is extended or adjusted under 35 U.S.C. 154(b) by 47 days.

(21) Appl. No.: 14/280,845

(22) Filed: May 19, 2014

(65) Prior Publication Data

US 2015/0184417 A1 Jul. 2, 2015

(51) Int. Cl.

| | |
|---|---|
| ***E04H 15/46*** | (2006.01) |
| ***E04H 15/48*** | (2006.01) |
| *E04H 15/50* | (2006.01) |

(52) U.S. Cl.

CPC ..... *E04H 15/46* (2013.01); *E04H 15/48* (2013.01); *E04H 15/50* (2013.01)

(58) Field of Classification Search

CPC ..... E04H 15/34; E04H 15/36; E04H 15/44; E04H 15/46; E04H 15/48

See application file for complete search history.

(56) References Cited

U.S. PATENT DOCUMENTS

| | | | | |
|---|---|---|---|---|
| 14,655 A | | 4/1856 | Hartwell | |
| 58,283 A | | 9/1866 | Palmer | |
| 379,274 A | | 3/1888 | Hamilton | |
| 1,061,547 A | * | 5/1913 | Kennedy et al. | E04H 15/44 135/138 |
| 1,347,107 A | * | 7/1920 | McCann | E04H 15/46 135/140 |
| 2,113,118 A | | 4/1938 | Pyatt | |
| 2,306,706 A | | 12/1942 | Lucas | |
| 2,448,895 A | | 9/1948 | Lawrence | |
| 2,530,765 A | | 11/1950 | Greenup | |
| 2,555,220 A | | 5/1951 | Brown | |
| 2,627,865 A | | 2/1953 | Mitchell et al. | |
| 2,716,993 A | | 9/1955 | Codrick | |
| 2,731,972 A | | 1/1956 | Braun | |
| 2,948,287 A | | 8/1960 | Rupert | |
| 2,960,993 A | | 11/1960 | Holmstrom | |
| 2,962,034 A | | 11/1960 | Finlayson | |

(Continued)

FOREIGN PATENT DOCUMENTS

| | | | | |
|---|---|---|---|---|
| AU | WO 2011022764 A1 | * | 3/2011 | E04H 15/48 |
| CA | 2022369 A1 | | 2/1991 | |

(Continued)

OTHER PUBLICATIONS

International Search Report, PCT Application No. PCT/CN2008/073142, Jan. 22, 2009.

*Primary Examiner* — David R Dunn
*Assistant Examiner* — Danielle Jackson
(74) *Attorney, Agent, or Firm* — Morgan, Lewis & Bockius LLP

(57) ABSTRACT

Disclosed is a frame for supporting a tent in folded and unfolded states comprising groups of supporting frames and resembling the letter "W" in the unfolded state. Sub-frames within the supporting frames comprise upright rods pivotally connected at their respective bottoms, the sub-frames resembling the letter "V" in the unfolded state. The frame of the utility model is simple in structure, large in supporting space, flexible in structure, and convenient to use.

12 Claims, 4 Drawing Sheets

(56) References Cited

U.S. PATENT DOCUMENTS

| | | | | |
|---|---|---|---|---|
| 2,984,249 | A | 5/1961 | Sears, Jr. et al. | |
| 3,054,413 | A | 9/1962 | Eshelman | |
| 3,171,417 | A | 3/1965 | Stokes | |
| 3,333,373 | A | 8/1967 | Taylor et al. | |
| 3,454,021 | A | 7/1969 | Morris | |
| 3,513,861 | A | 5/1970 | Johnson | |
| 3,738,378 | A | 6/1973 | Williams | |
| 3,810,482 | A | 5/1974 | Beavers | |
| 3,896,831 | A | 7/1975 | Feldman et al. | |
| 3,929,146 | A | 12/1975 | Maiken | |
| 4,077,417 | A | 3/1978 | Beavers | |
| 4,148,332 | A | 4/1979 | Huddle | |
| 4,201,237 | A | 5/1980 | Watts et al. | |
| 4,280,521 | A | 7/1981 | Zeigler | |
| 4,285,354 | A | 8/1981 | Beavers | |
| 4,627,210 | A | 12/1986 | Beaulieu | |
| 4,637,748 | A | 1/1987 | Beavers | |
| 4,750,509 | A | 6/1988 | Kim | |
| 4,787,182 | A | 11/1988 | Serge | |
| 4,819,680 | A | 4/1989 | Beavers | |
| 4,838,003 | A | 6/1989 | Zeigler | |
| 4,941,499 | A | 7/1990 | Pelsue et al. | |
| 4,944,321 | A * | 7/1990 | Moyet-Ortiz | B60J 11/00 135/148 |
| 4,971,090 | A | 11/1990 | Uhl | |
| 5,293,890 | A | 3/1994 | Park et al. | |
| 5,328,286 | A | 7/1994 | Lee | |
| 5,333,634 | A | 8/1994 | Taylor | |
| 5,361,794 | A | 11/1994 | Brady | |
| 5,423,341 | A | 6/1995 | Brady | |
| 5,617,681 | A | 4/1997 | Lyons | |
| 5,628,338 | A | 5/1997 | Stumbo | |
| 5,634,483 | A | 6/1997 | Gwin | |
| 5,666,986 | A | 9/1997 | Fox | |
| 5,732,726 | A | 3/1998 | Lee | |
| 5,797,695 | A | 8/1998 | Prusmack | |
| 5,884,646 | A | 3/1999 | Ju | |
| 5,943,837 | A | 8/1999 | Esser et al. | |
| 6,021,795 | A | 2/2000 | Long et al. | |
| 6,032,430 | A | 3/2000 | Soukup | |
| 6,167,898 | B1 | 1/2001 | Larga et al. | |
| 6,286,530 | B1 | 9/2001 | Hussey | |
| 6,296,415 | B1 | 10/2001 | Johnson et al. | |
| 6,463,948 | B2 * | 10/2002 | Lee | E04H 15/44 135/136 |
| 6,516,823 | B1 | 2/2003 | Glover et al. | |
| 6,591,571 | B2 | 7/2003 | Fritsche et al. | |
| 6,604,844 | B2 | 8/2003 | Hussey | |
| 6,666,223 | B2 | 12/2003 | Price et al. | |
| 6,772,780 | B2 | 8/2004 | Price | |
| 6,776,179 | B1 | 8/2004 | Chen | |
| 6,854,476 | B1 | 2/2005 | Chai | |
| 6,868,858 | B2 | 3/2005 | Suh | |
| 6,874,519 | B2 | 4/2005 | Chiang | |
| 6,892,744 | B2 | 5/2005 | Feldpausch et al. | |
| 7,025,075 | B2 | 4/2006 | Suh | |
| 7,040,585 | B2 | 5/2006 | Cheng et al. | |
| 7,059,094 | B2 | 6/2006 | Yamawaki | |
| D544,941 | S | 6/2007 | Rogers | |
| 7,311,113 | B2 | 12/2007 | Suh | |
| 7,316,239 | B2 * | 1/2008 | Yang | E04H 15/003 135/117 |
| RE40,544 | E | 10/2008 | Suh | |
| 7,481,235 | B2 | 1/2009 | Prusmack | |
| 7,546,845 | B2 | 6/2009 | Prusmack | |
| D705,884 | S * | 5/2014 | Jin | D21/834 |
| 8,910,648 | B2 * | 12/2014 | Jin | E04H 15/48 135/114 |
| 2001/0050098 | A1 * | 12/2001 | Lee | E04H 15/425 135/156 |
| 2003/0005953 | A1 | 1/2003 | Erbetta et al. | |
| 2006/0054208 | A1 | 3/2006 | Romano | |
| 2007/0051399 | A1 | 3/2007 | Jung | |
| 2007/0215192 | A1 | 9/2007 | Hoffman | |
| 2013/0014794 | A1 * | 1/2013 | Jin | E04H 15/46 135/139 |
| 2014/0261601 | A1 * | 9/2014 | Jin | E04H 15/48 135/136 |
| 2014/0290710 | A1 * | 10/2014 | Choi | E04H 15/38 135/126 |
| 2015/0083177 | A1 * | 3/2015 | Hotes | E04H 15/48 135/151 |

FOREIGN PATENT DOCUMENTS

| | | | | |
|---|---|---|---|---|
| CN | 1030790 | C | 1/1996 | |
| CN | 2506736 | Y | 8/2002 | |
| CN | 2635827 | Y | 8/2004 | |
| CN | 201129060 | Y | 10/2008 | |
| CN | 202249138 | U * | 5/2012 | |
| CN | 203097418 | U * | 7/2013 | |
| FR | 1121851 | A * | 8/1956 | E04H 15/34 |
| FR | 68588 | E * | 5/1958 | E04H 15/34 |
| GB | 2201703 | A | 9/1988 | |
| GB | 2259927 | A | 3/1993 | |
| GB | 2 273 723 | B | 8/1997 | |
| GB | 2482745 | A * | 2/2012 | E04H 15/48 |
| WO | WO 2011/047430 | A1 | 4/2011 | |

* cited by examiner

TENT FRAME

FIELD

The utility model relates to outdoor leisure products, and particularly to a tent frame.

BACKGROUND

Tents have various forms including large and small sizes, and square, circular and hexagonal shapes. The tent primarily consists of a tent cloth and a tent frame for supporting the tent cloth. The common tent frame generally consists of several groups of supporting rods for connecting top rods, and the top rods form a top support structure. However, well-known tents suffer from a general drawback in that they usually are relatively complicated in structure. Several groups of rods are required to support the tent cloth. It is difficult and time-consuming to put up a support structure, and the production cost is also increased. Meanwhile, the tent frame is generally designed to have a fixed structure, and the unfolded form is also fixed, leading to a small unfolded space. Moreover, the available space of the unfolded tent is limited, and cannot be further expanded by modifying the tent.

DETAILED DESCRIPTION

The utility model will be elucidated in detail hereinafter by referring to specific embodiments, so as to provide further explanations for the technical solution of the utility model.

Figure 1:
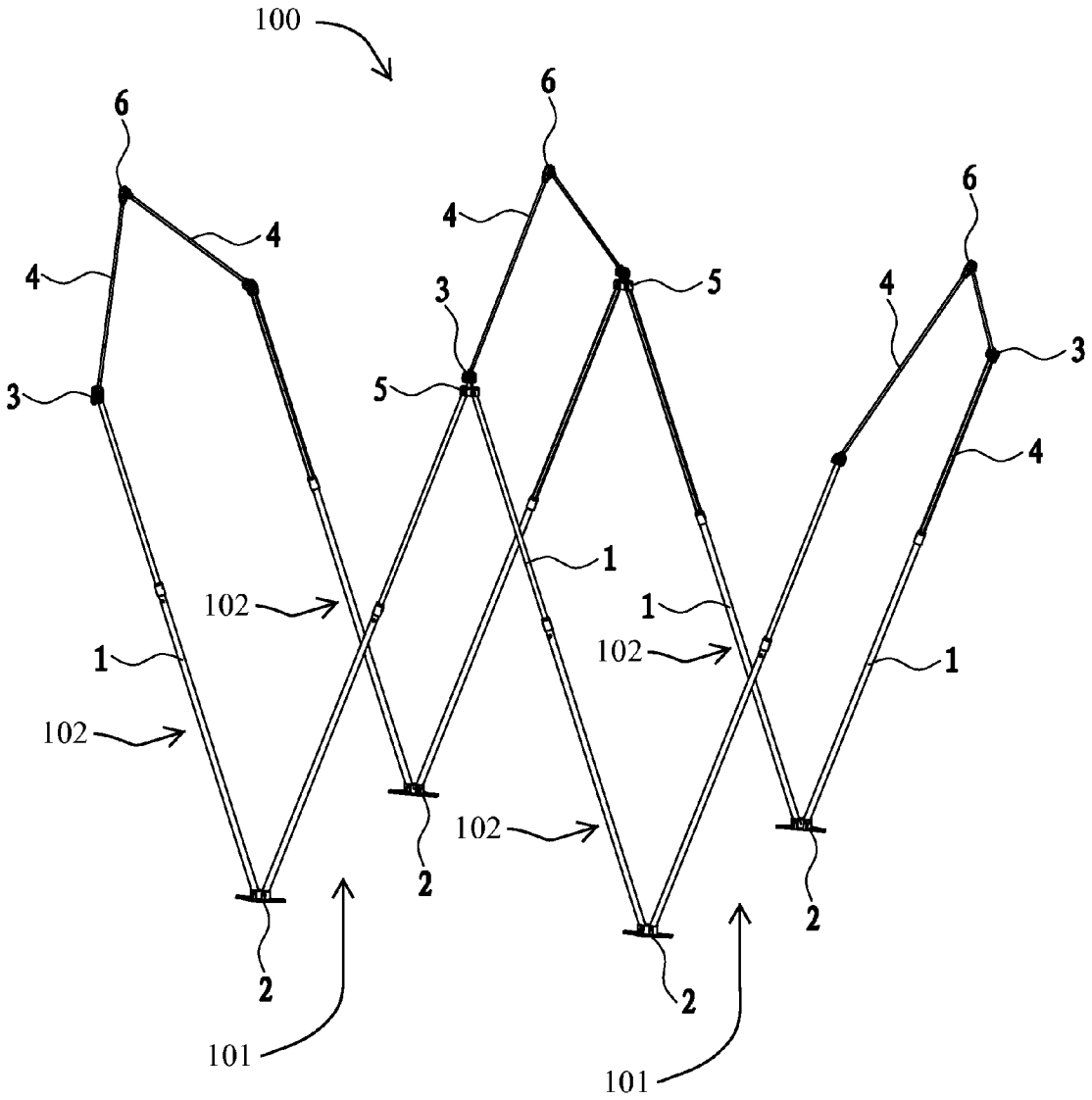
FIG. 1 is a structural view illustrating an unfolded state of the utility model.
Figure 2:
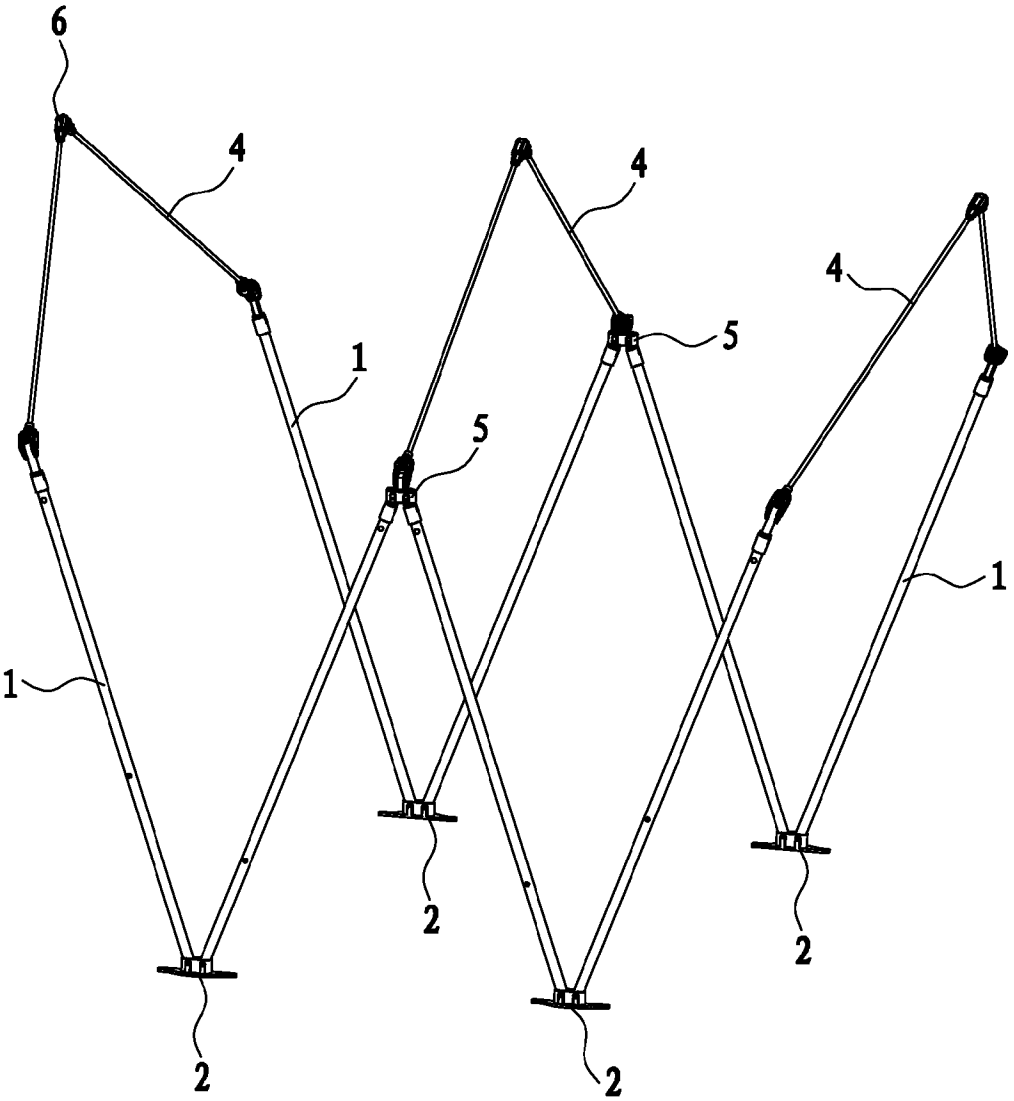
FIG. 2 is a structural view illustrating a half folded state of the utility model.

FIG. 1 depicts a tent frame 100 comprising at least a pair of supporting frames 101 that when in an unfolded state (e.g., expanded), form a "W" shape in accordance with one embodiment. Tent frame 100 supports a tent cloth (not shown) to form a shelter, e.g., a tent. Supporting frame 101 includes two groups of frames—sub-frames 102—which are connected together. Sub-frame 102 includes two upright rods 1, which are telescopic, e.g., they include telescopic sleeves. A bottom end of each of the two upright rods 1 is pivotally connected to a pivoting seat 2. The upright rods 1 form a "V" shape when sub-frame 102 is in the unfolded state (expanded). Pivoting seat 2 limits an opening angle (e.g., an included angle) between the two upright rods 1, so as to ensure support of upright rods 1. A top end of each upright rod 1 is connected to a corresponding one-way connecting piece 3, which is folded in a first direction, e.g., downward. One-way connecting piece 3 is connected to top rods 4. The top ends of upright rods 1 of the two sub-frames 102 intersect with each other, pivotally connected to a position limiting connecting piece 5, which folds in the first direction, and to one-way connecting piece 3. Position limiting connecting piece 5 limits the opening angle between intersecting upright rods 1 from respective sub-frames 102 as depicted in FIG. 1.

The two supporting frames 101 are arranged symmetrically. Two respective top rods 4 of the two supporting frames 101 are connected by a one-way connecting piece 6 which is folded in a second direction, e.g., connecting piece 6 moves downward while top rods 4 move upward relative to connecting piece 6. The three groups of top rods 4 which are connected to the two supporting frames 101 form a top surface support for tent frame 100. Accordingly, a "W" shaped tent frame is formed in the utility model. When tent frame 100 is connected with (e.g., supports) a tent cloth (not shown), it forms an elongated tent.

Figure 3:
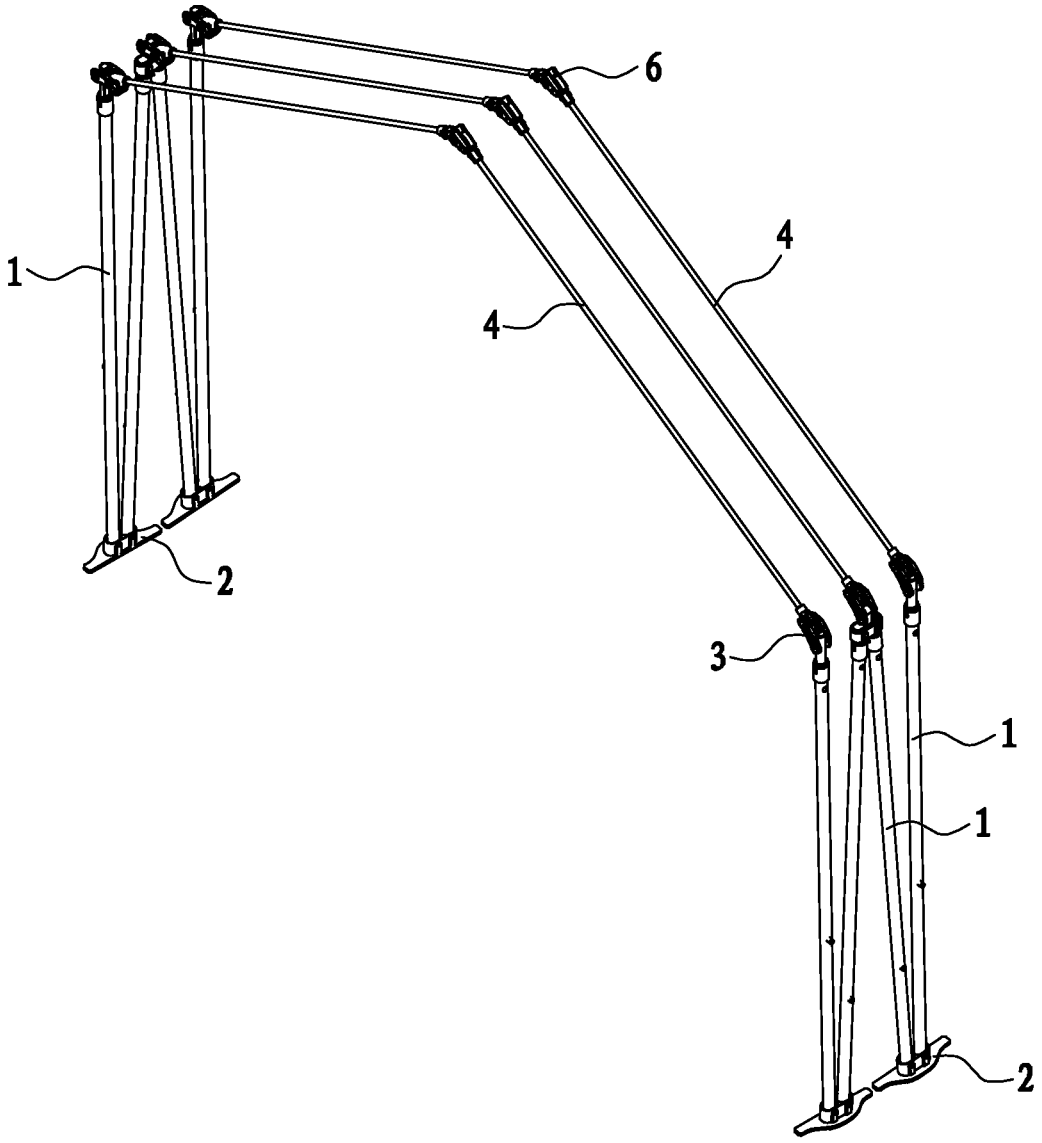
FIG. 3 is a structural view illustrating a further folded state of the utility model.
Figure 4:
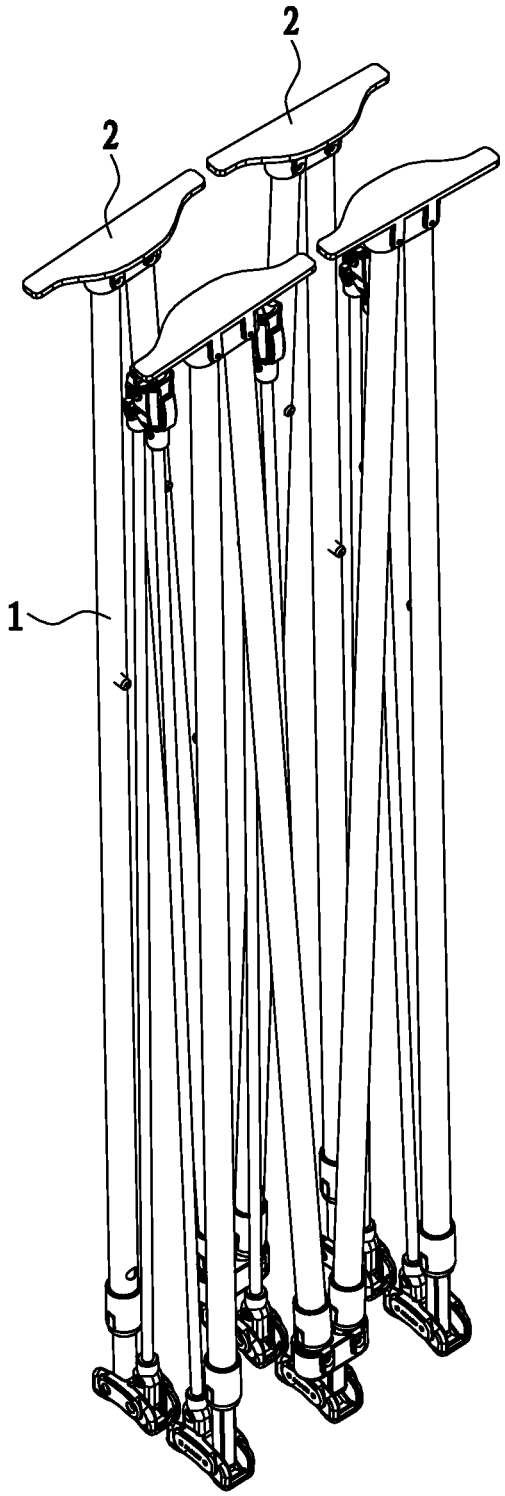
FIG. 4 is a structural view illustrating a fully folded state of the utility model.

To fold the tent into folded states shown in FIGS. 1-4, upright rods 1 are first contracted (FIG. 2), then pivoted toward one another at pivoting seat 2 (FIG. 3), thereby folding sub-frames 102 (which, when expanded, form a V-shape). As a result, the upright rods of supporting frames 101 (which, when expanded, form a W-shape) are folded as shown in FIG. 3. Under the connecting action of one-way connecting piece 3, which is folded in the first direction, e.g., downward, and one-way connecting piece 6, which is folded in the second direction (e.g., when moved downward), both upright rods 1 in sub-frame 102 are drawn close to top rods 4 and are then folded. As a result, sub-frames 102, which have been drawn close to each other, have become folded so that frame 100 (and the tent) is folded to a minimum volume when folded as a whole, as shown in FIG. 4.

In another embodiment, supporting frames 101 may be further extended by adding additional sub-frames 102 or supporting frames 101 to increase the length of frame 100, thereby increasing the volume of space inside the tent. Tent frame 100 is simple in structural connections, convenient to fold and unfold, simple in structure, and convenient to use.

Although the invention has been described in connection with specific embodiments, variations of these embodiments will be obvious to those of ordinary skill in the art. For example, connectors and related components for rods and the like can be used to advantage, e.g., for other types of collapsible devices and shelters such as portable awnings, gazebos, screen houses, sunshades, umbrellas, strollers, and cribs. Other modifications and variations likewise fall within the scope of the appended claims. Therefore, the spirit and scope of the claims should not be limited to the foregoing description.

Only those claims specifically reciting "means for" or "step for" should be construed in the manner required under the sixth paragraph of 35 U.S.C. §112.

What is claimed is:

1. A frame for supporting a tent in a folded state and an unfolded state, the frame comprising:

first and second supporting frames, each first and second supporting frame comprising:

a first sub-frame comprising:

first and second upright rods, each having a top end and a bottom end, the bottom ends of the first and second upright rod pivotally interconnected;

a second sub-frame comprising:

third and fourth upright rods, each having a top end and a bottom end, the bottom ends of the third and fourth upright rod pivotally interconnected;

a position limiting connector pivotally connected to a first one-way connector, and pivotally connecting the top end of the second upright rod of the first sub-frame and the top end of the third upright rod of the second sub-frame, the position limiting connector limiting an opening angle between the second upright rod of the first sub-frame and the third upright rod of the second sub-frame when unfolded to be less than 180 degrees, and allowing the second upright rod of the first sub-frame and the third upright rod of the second sub-frame to rotate between a closed angle and the opening angle for folding and unfolding of the frame;

a first top rod pivotally connected to the top end of the first upright rod of the first sub-frame;

a second top rod pivotally connected to the first one-way connector, the first one-way connector allowing the second top rod and the position limiting connector, along with the second upright rod of the first sub-frame and the third upright rod of the second sub-frame pivotally connected to the position limiting connector, to fold toward one another into the folded state; and a third top rod pivotally connected to the top end of the fourth upright rod of the second sub-frame, wherein the first, second and third top rods of the first supporting frame are pivotally connected to the first, second and third top rods of the second supporting frame, respectively.

2. The frame of claim 1, wherein each of the first and second supporting frames further comprises:

a second one-way connector disposed between the first upright rod and the first top rod, the second one-way connector allowing the first upright rod and the first top rod to fold toward one another in only a first direction to fold the frame into the folded state;

a third one-way connector disposed between the fourth upright rod and the third top rod, the third one-way connector allowing the fourth upright rod and the third top rod to fold toward one another in only a first direction to fold the frame into the folded state.

3. The frame of claim 2, further comprising:

a fourth one-way connector disposed between the first top rod of the first supporting frame and the first top rod of the second supporting frame, the fourth one-way connector allowing the first top rod of the first supporting frame and the first top rod of the second supporting frame to fold toward one another in only a second direction to fold the frame into the folded state;

a fifth one-way connector disposed between the second top rod of the first supporting frame and the second top rod of the second supporting frame, the fifth one-way connector allowing the second top rod of the first supporting frame and the second top rod of the second supporting frame to fold toward one another in only a second direction to fold the frame into the folded state; and a sixth one-way connector disposed between the third top rod of the first supporting frame and the third top rod of the second supporting frame, the sixth one-way connector allowing the third top rod of the first supporting frame and the third top rod of the second supporting frame to fold toward one another in only a second direction to fold the frame into the folded state.

4. The frame of claim 3, wherein the second direction is opposite the first direction.

5. The frame of claim 1, wherein each of the first and second supporting frames further comprises:

a first bottom pivoting seat pivotally interconnecting the bottom end of the first upright rod to the bottom end of the second upright rod, and a second bottom pivoting seat pivotally interconnecting the bottom end of the third upright rod to the bottom end of the fourth upright rod.

6. The frame of claim 5, wherein the first pivoting seat limits an opening angle between the first and second upright rods, and the second pivoting seat limits an opening angle between the third and fourth upright rods.

7. The frame of claim 1, wherein the upright rods are telescopic.

8. The frame of claim 1, wherein the first sub-frame and the second sub-frame each exhibits a V-shape in the unfolded state.

9. The frame of claim 1, wherein each of the first and second supporting frames exhibits a W-shape in the unfolded state.

10. The frame of claim 1, wherein the first top rod is adjacent the second top rod, and the first upright rod is adjacent the second upright rod in the folded state.

11. The frame of claim 10, wherein the third top rod is adjacent the second top rod, and the third upright rod is adjacent the fourth upright rod in the folded state.

12. A tent comprising:

the frame of claim 1, and a tent cloth supported by the frame.

* * * * *